US007680423B2

(12) United States Patent
Hayashi et al.

(10) Patent No.: US 7,680,423 B2
(45) Date of Patent: Mar. 16, 2010

(54) IMAGE FORMING APPARATUS AND METHOD FOR CONTROLLING WEAR OF A PHOTOCONDUCTOR DRUM

(75) Inventors: Kenji Hayashi, Saiatama (JP); Kazuhiro Iihara, Saiatama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 442 days.

(21) Appl. No.: 10/580,821

(22) PCT Filed: May 19, 2004

(86) PCT No.: PCT/JP2004/006736

§ 371 (c)(1),
(2), (4) Date: May 26, 2006

(87) PCT Pub. No.: WO2005/052697

PCT Pub. Date: Jun. 9, 2005

(65) Prior Publication Data

US 2007/0110462 A1 May 17, 2007

(30) Foreign Application Priority Data

Nov. 28, 2003 (JP) ..... 2003-398699

(51) Int. Cl.
*G03G 15/00* (2006.01)

(52) U.S. Cl. ..... 399/45; 399/46; 399/53; 399/66; 399/67

(58) Field of Classification Search ..... 399/45–46, 399/53, 66–67
See application file for complete search history.

(56) References Cited

U.S. PATENT DOCUMENTS 4,113,374 A * 9/1978 Nakamura et al. ..... 399/76
4,786,945 A 11/1988 Sambayashi et al.
4,998,138 A 3/1991 Sambayashi et al.
5,294,958 A 3/1994 Isobe et al.
5,669,039 A 9/1997 Ohtsuka et al.

(Continued)

FOREIGN PATENT DOCUMENTS

JP A-57-35874 2/1982

(Continued)

OTHER PUBLICATIONS

English translation of Hara et al. (JP publication 2002-304102), published Oct. 18, 2002.*

*Primary Examiner*—David M Gray
*Assistant Examiner*—Geoffrey T Evans
(74) *Attorney, Agent, or Firm*—Oliff & Berridge, PLC

(57) ABSTRACT

Wear of the photoreceptor drum can be suppressed, and degradation of image quality of recorded images can be suppressed.

When instruction information (image information and control information) for instructing formation of a developed image on a plurality of recording sheets S is inputted, driving of the photoreceptor drum 50, the developing device 52 and the transfer roller 56 is controlled such that formation of the developed image on a plurality of the recording sheets S according to the instruction information is continuously performed, and driving of the photoreceptor drum 50, the developing device 52 or the transfer roller 56 is controlled such that, in the course of the continuous image formation, driving of the photoreceptor drum 50, the developing device 52 or the transfer roller 56 is halted at least once.

11 Claims, 5 Drawing Sheets

U.S. PATENT DOCUMENTS

| | | | | |
|---|---|---|---|---|
| 5,689,759 | A * | 11/1997 | Isemura et al. | 399/45 |
| 6,151,462 | A | 11/2000 | Fukuzawa et al. | |
| 6,253,039 | B1 | 6/2001 | Nakano et al. | |

FOREIGN PATENT DOCUMENTS

| | | | |
|---|---|---|---|
| JP | A-62-227173 | | 10/1987 |
| JP | 63253971 | A * | 10/1988 |
| JP | A-01-296266 | | 11/1989 |
| JP | A-09-218608 | | 8/1997 |
| JP | A-2001-228779 | | 8/2001 |
| JP | A-2002-304102 | | 10/2002 |
| JP | A-2003-107957 | | 4/2003 |

* cited by examiner

FIG. 2

MEMORY 24

PRINTING DRIVE CONTROL INFORMATION

| PAPER TYPE | NUMBER OF CONTINUOUS PRINTING SHEETS | RUNNING TIME FOR ONE SHEET (sec) | PAPER STANDBY TIME (sec) | WAITING TIME (sec) |
|---|---|---|---|---|
| A3 | — | 2.0 | 0.66 | — |
| A4 | | 1.0 | 0.66 | |
| B4 | | 0.8 | 0.66 | |
| ⋮ | | ⋮ | ⋮ | |
| NON-REGULAR FORM "A" | 20 | 1.0 | 2.43 | 60.0 |
| NON-REGULAR FORM "B" | 25 | 1.0 | 2.30 | 72.0 |
| NON-REGULAR FORM "C" | 30 | 1.0 | 2.12 | 84.0 |
| ⋮ | ⋮ | ⋮ | ⋮ | ⋮ |

IMAGE FORMING APPARATUS AND METHOD FOR CONTROLLING WEAR OF A PHOTOCONDUCTOR DRUM

TECHNICAL FIELD

The present invention pertains to an image forming apparatus and an image formation method, and more particularly relates to an image forming apparatus, comprising a photoreceptor drum on which the electrostatic latent image of an image as an object of image formation is optically formed in the driven state; developing means which toner-develops the electrostatic latent image formed on said photoreceptor drum in the driven state; and transfer means for transferring a developed image obtained by toner development by said developing means to image recording medium in the driven state, and an image formation method for the image forming apparatus.

BACKGROUND ART

Conventionally, with the image forming apparatus of the xerography type, such as the copying machine, the laser beam printer, and the like, a recorded image is generally formed by forming a toner image on the photoreceptor drum surface according to the image information, and then transferring the toner image to the recording sheet. Specifically, with the laser beam printer, for example, the surface of the photoreceptor drum is first charged to a prescribed background potential, and by using a laser beam modulated on the image information for scanning-exposing the surface of the photoreceptor drum, a latent image is formed. And, the electrostatic latent image is developed by the developing apparatus using toner for rendering it visible as a toner image, which is then followed by transferring the toner image to a recording sheet, and by heating the recording sheet with the fuser for fixing, a recorded image is obtained.

Conventionally, for this type of image forming apparatus, which forms an image by heating and fixing, in order to prevent excessive temperature rise in the fuser resulting from the size of the recording sheet being smaller than that of the regular form, the art which, when the recording sheet as the object of image formation is smaller in size, gradually reduces the number of recording sheets per unit time according to the number of continuous recording sheets is disclosed in the patent reference 1.

According to this art, as shown in FIG. 5 as one example, when image formation is continuously performed on recording sheets of regular size the area contacting the fixing roller provided in the fuser for the recording sheet is relatively wide, and no excessive temperature rise occurs, thus image formation is continuously performed to the last page with the running time for one sheet (the period of time per recording sheet in which a prescribed location is passed at the time of image formation) and the paper standby time (the period of time per recording sheet for which the operation of carrying-out the recording sheet from the carrying-out section is halted) which have been predetermined such that a prescribed printing speed (36 ppm (pages per minute) in the same figure) is provided.

Contrarily to this, when image formation is continuously performed on recording sheets of a smaller size, the paper standby time is gradually lengthened for lowering the number of recording sheets per unit time, as the number of recorded sheets is increased in three steps of 1 to 20 sheets, 21 to 50 sheets, and more than 50 sheets, whereby the fuser is prevented from having an excessive temperature rise. In the same figure, the printing speed for the step of more than 50 sheets is fixed because, during the paper standby time, e, which is set for this step, the temperature of the fixing roller is sufficiently lowered, and thereafter on whatever number of sheets image formation is continuously performed, no excessive temperature rise will occur.

Patent reference 1: Japanese Patent Laid-Open Publication No. 9-218608

DISCLOSURE OF THE INVENTION

Problems to be Solved by the Invention

However, with the above-mentioned art as disclosed in the patent reference 1, excessive temperature rise of the fuser can be prevented, but for this feature, the paper standby time between respective recording sheets is changed according to the number of continuously recorded sheets, thereby controlling the number of recording sheets per unit time (the printing speed), while the rotation drive of the photoreceptor drum, the rotation drive of the transfer roller, the operation of stirring the toner by the developing apparatus, and the like, are continued to be performed, which has presented problems that wear of the surface of the photoreceptor drum is promoted, and the toner is excessively charged, resulting in the developability being degraded, and the quality of the recorded image being easily lowered.

The present invention has been made to solve the above-mentioned problems, and the purpose thereof is to provide an image forming apparatus and an image formation method which can suppress wear of the photoreceptor drum, and can suppress degradation of the image quality of the recorded image.

Means to Solve the Problems

In order to achieve the above-mentioned purpose, the image forming apparatus of claim 1 provides an image forming apparatus, comprising a photoreceptor drum on which, in a driven state, an electrostatic latent image of an image for formation is optically formed; developing means which, in a driven state, toner-develops the electrostatic latent image formed on the photoreceptor drum; transfer means, in a driven state, for transferring to an image recording medium a developed image obtained by toner development by the developing means; and control means which, when instruction information for instructing formation of the developed image on plural sheets of the image recording medium is inputted, controls driving of the photoreceptor drum, the developing means and the transfer means such that formation of the developed image on the plural sheets of the image recording medium according to the instruction information is continuously performed, and controls driving of at least one of the photoreceptor drum, the developing means or the transfer means such that, in the course of the continuous image formation, driving of at least one of the photoreceptor drum, the developing means or the transfer means is halted at least once.

According to the image forming apparatus of claim 1, on a photoreceptor drum, the electrostatic latent image of an image for image formation is optically formed in the driven state of the photoreceptor drum; by developing means, the electrostatic latent image formed on the photoreceptor drum is toner-developed in the driven state of the developing means; by transfer means, a developed image obtained by toner development by the developing means is transferred to image recording medium in the driven state of the transfer means. The above-mentioned image recording medium is equivalent to the above-described recording sheet, and there is no particular restriction to the size, thickness, material, and the like, thereof.

Herein, in the present invention, by control means, when instruction information for instructing formation of the developed image on the plural sheets of the image recording medium is inputted, driving of the photoreceptor drum, the developing means and the transfer means are controlled such that formation of the developed image on the plural sheets of the image recording medium according to the instruction information is continuously performed, and driving of at least one of the photoreceptor drum, the developing means or the transfer means is controlled such that, in the course of the continuous image formation, driving of at least one of the photoreceptor drum, the developing means or the transfer means is halted at least once.

Thus, according to the image forming apparatus of claim 1, when instruction information for instructing formation of the developed image on the plural sheets of the recording medium is inputted, driving the photoreceptor drum, the developing means and the transfer means is controlled such that formation of the developed image on the plural sheets of the recording medium according to the instruction information is continuously performed, and driving of at least one of the photoreceptor drum, the developing apparatus or the transfer means is controlled such that, in the course of the continuous image formation, driving of at least one of the photoreceptor drum, the developing apparatus or the transfer means is halted at least once, thus, when driving of at least one of the photoreceptor drum or the transfer means is halted, wear of the photoreceptor drum can be suppressed, and when driving the developing means is halted, degradation in image quality of the recorded image can be suppressed.

As in the invention of claim 2, the control means of the present invention may be adapted to control at least one of the photoreceptor drum, the developing means or the transfer means such that, every time the number of continuously image-formed sheets reaches the prescribed number of sheets for the image recording medium, at least one of the photoreceptor drum, the developing means or the transfer means is halted for a prescribed period of time.

In addition, the invention of claim 2 may be adapted to further comprise a fuser which fixes the developed image transferred to the image recording medium on the image recording medium by heat, and to determine the prescribed number of sheets and the prescribed periods of time as those with which image formation on the image recording medium can be continuously performed by the prescribed number of sheets without the temperature of the fuser exceeding a prescribed one, as in the invention of claim 3.

Particularly, the invention of claim 2 or claim 3 may be adapted to further comprise specification means for specifying the type of the image recording medium, memory means which previously stores the prescribed number of sheets and the prescribed periods of time according to the type of the image recording medium for each type of the image recording medium, the control means carrying out the control by reading out the prescribed number of sheets and the prescribed periods of time according to the type of the image recording medium that has been specified by the specification means from the memory means, as in the invention of claim 4. The above-mentioned memory means includes semiconductor memory devices, such as ROM (Read Only Memory), EEPROM (Electrically Erasable and Programmable ROM), flash EEPROM, and the like; and portable type recording medium, such as SmartMedia (a tradename), xD-Picture Card, CompactFlash, ATA (AT Attachment) card, microdrive, floppy disk, CD-R (Compact Disc-Recordable), CD-RW (Compact Disc-ReWritable), magneto-optical disk, and the like.

Further, the invention of claim 4 is preferably adapted to be that wherein the type of the image recording medium is the type according to at least one of the size of the image recording medium, the thickness of the image recording medium, or the material of the image recording medium, as in the invention of claim 5.

On the other hand, in order to achieve the above-mentioned purpose, the image formation method of claim 10 comprises a photoreceptor drum on which, in a driven state, an electrostatic latent image of an image for image formation is optically formed; developing means which, in a driven state, toner-develops the electrostatic latent image formed on the photoreceptor drum; and transfer means for, in a driven state, transferring a developed image obtained by toner development by the developing means to an image recording medium, including: when instruction information for instructing formation of a developed image on plural sheets of the image recording medium is inputted, controlling driving of the photoreceptor drum, the developing means and the transfer means such that formation of the developed image on plural sheets of the image recording medium according to the instruction information is continuously performed, and controlling driving of at least one of the photoreceptor drum, the developing means or the transfer means such that, in the course of the continuous image formation, driving of at least one of the photoreceptor drum, the developing means or the transfer means is halted at least once. Therefore, the present invention functions in the same manner as the invention of claim 1, thus, when driving of at least one of the photoreceptor drum or the transfer means is halted, wear of the photoreceptor drum can be suppressed, and when driving the developing means is halted, degradation in image quality of the recorded image can be suppressed, as with the invention of claim 1.

The present invention may be adapted to further include controlling at least one of the photoreceptor drum, the developing means or the transfer means such that, every time the number of continuously image-formed sheets reaches the prescribed number of sheets for the image recording medium, at least one of the photoreceptor drum, the developing means or the transfer means is halted for a prescribed period of time.

EFFECTS OF THE INVENTION

According to the present invention, effects can be obtained that, when instruction information for instructing formation of the developed image the on the plural sheets of the recording medium is inputted, driving the photoreceptor drum, the developing means and the transfer means is controlled such that formation of the developed image on the plural sheets of the recording medium according to the instruction information is continuously performed, and driving of at least one of the photoreceptor drum, the developing apparatus to the transfer means is controlled such that, in the course of the continuous image formation, driving of at least one of the photoreceptor drum, the developing apparatus or the transfer means is halted at least once, thus, when driving of at least one of the photoreceptor drum or the transfer means is halted, wear of the photoreceptor drum can be suppressed, and when driving the developing means is halted, degradation in image quality of the recorded image can be suppressed.

BRIEF DESCRIPTION OF THE DRAWINGS

FIG. 2 is a schema illustrating a composition of a printing drive control information pertaining to the embodiment;

BEST MODE FOR CARRYING OUT THE INVENTION

Figure 1:
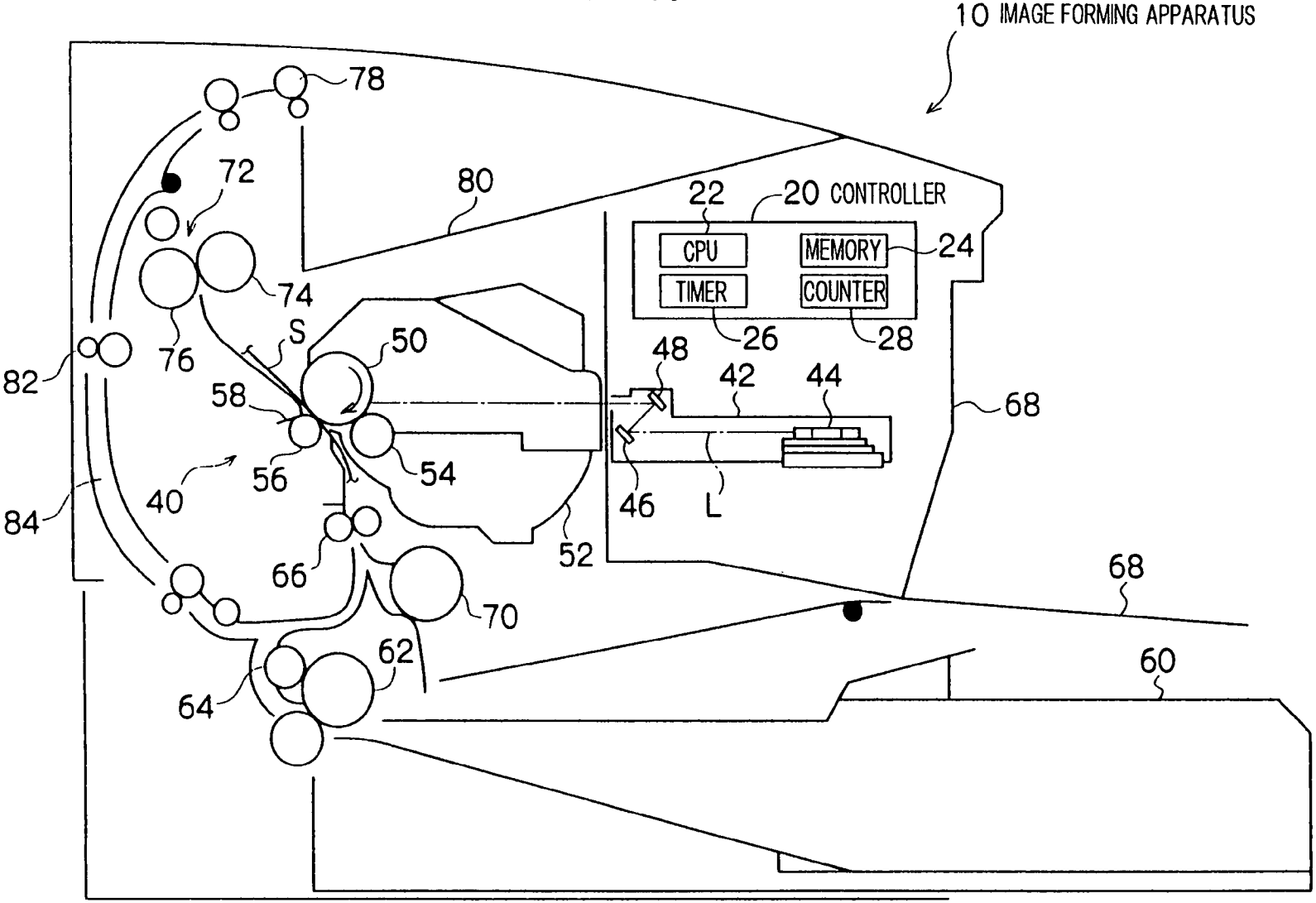
FIG. 1 is a schematic drawing illustrating the configuration of the image forming apparatus 10 pertaining to an embodiment.

Hereinbelow, with reference to the drawings, the best mode for carrying out the present invention will be described in detail. First, with reference to FIG. 1, the configuration of an image forming apparatus 10 pertaining to the present embodiment will be described.

As shown in the same figure, the image forming apparatus 10 pertaining to the present mode comprises a controller 20 which controls the operation of the entire image forming apparatus 10; and an image output section 40 which outputs an image on the basis of the image information inputted from the external. To the controller 20, image information sent through a host computer (not shown), such as a personal computer, or a communication line, such as a telephone line, LAN, or the like; image information read out by an image reading apparatus (not shown), such as a scanner, a digital camera, or the like; or the like, is inputted together with control information including information indicating the type of the recording sheet, information indicating the number of image forming sheets, and the like to be used for image formation.

In the image output section 40, a scanning exposure section 42 which carries out scanning exposure for the image indicated by the image information on the basis of the image information inputted from the external is disposed, and in the scanning exposure section 42, scanning exposure with a laser beam L is carried out on the basis of the above-mentioned image information.

In other words, in the scanning exposure section 42, the laser beam L according to the gradation data in the above-mentioned image information is emitted from a semiconductor laser (not shown), and the laser beam L is deflection-scanned by a rotating multi-faceted mirror 44, being scanned on a photoreceptor drum 50 through a reflection mirror 46 and a reflection mirror 48 in this order. The photoreceptor drum 50 is rotation-driven by driving means (not shown) in the direction of the arrow in the same figure at a prescribed speed.

This photoreceptor drum 50 is charged by a charging roller (not shown) to a prescribed potential before the laser beam L scanning exposure according to the image information, whereby an electrostatic latent image is formed on the surface. And, the electrostatic latent image formed on the photoreceptor drum 50 is developed by a developing roller 54 in a developing device 52 for rendering it visible as a toner image.

On the other hand, the toner image formed on the photoreceptor drum 50 is transferred onto a recording sheet S by a transfer roller 56 which is disposed so as to be in contact with the photoreceptor drum 50, and the recording sheet S on which the toner image is transferred has the charge removed by a separation charging assembly 58 composed of needle-like electrodes before being separated from the photoreceptor drum 50. To this separation charging assembly 58 composed of needle-like electrodes, an AC (alternate current) voltage or an AC voltage on which a DC (direct current) voltage is superposed is applied.

The recording sheet S is fed from a sheet feet cassette 60 by a feed roller 62 which is disposed in the lower portion of the image forming apparatus 10. And, the recording sheet S fed is conveyed to the surface of the photoreceptor drum 50 by a feed roller 64 and a registration roller 66. In the image forming apparatus 10 pertaining to the present embodiment, the recording sheet S which is fed from the sheet feet cassette 60 is of regular form size, such as A4 size or B5 size, and the recording sheet is called the "regular form recording sheet" hereinafter.

In addition, the image forming apparatus 10 is also provided with a manual feed tray 68 on the side face at right in the same figure, and by turning the manual feed tray 68 in a clockwise direction to a substantially horizontal position and stopping it, a recording sheet different in size, thickness, material, and the like, from the regular form recording sheet (hereinafter to be called "non-regular form recording sheet") can be fed from the manual feed tray 68, and fed through a feed roller 70 having a large diameter.

For the image forming apparatus 10 pertaining to the present embodiment, plural sizes of non-regular form recording sheet which may be handled as a recording object are prescribed, and in this specification, these sizes are expressed as a non-regular form "a", a non-regular form "b" . . . , for convenience. Hereinbelow, the "regular form recording sheet" and the "non-regular form recording sheet" will be called the "recording sheet" as a generic term.

On the other hand, the recording sheet S to which the toner image has been transferred from the photoreceptor drum 50 has the charge removed by the separation charging assembly 58 composed of needle-like electrodes, as described above, before being separated from the surface of the photoreceptor drum 50, and then being conveyed to a fuser 72.

The toner image on the recording sheet S conveyed to the fuser 72 is fixed on the recording sheet S under heat and pressure by a heating roller 74 and a pressure roller 76 before the recording sheet S being discharged onto a discharge tray 80 provided in the upper portion of the image forming apparatus 10 by a discharge roller 78, and the image formation process being completed.

In addition, when an image is to be printed on both front and back sides of the recording sheet S, the recording sheet S on one side of which an image has been printed is not delivered onto the discharge tray 80 as it is, but is guided to a duplexing unit 84 comprising plural feed rollers 82 by reversing the discharge roller 78 for again feeding it to the transfer position of the photoreceptor drum 50 with the front and back of the recording sheet S being inverted.

On the other hand, the controller 20 controls the respective sections of the image forming apparatus 10, comprising a CPU (Central Processing Unit) 22 having a role to apply a variety of image processing to the image information inputted from the external; a memory 24 which previously stores a variety of programs and parameters, and the like, being constituted by a nonvolatile semiconductor memory device (a flash memory in the present embodiment) which functions as a work area, or the like, in implementation of the variety of programs; a timer 26 which counts the elapsed time from the moment of reset; and a counter 28 which counts the number of image formed sheets (number of printed sheets) from the moment of reset.

These memory 24, timer 26 and counter 28 are connected to the CPU 22, respectively, and the CPU 22 is capable of getting access to the memory 24, counting the time with the timer 26, and counting the number of image formed sheets with the counter 28, respectively. In FIG. 1, in order to avoid complexity, drawing of a connection line from the CPU 22 to the memory 24, the timer 26 and the counter 28 is omitted.

By the way, in a prescribed region of the memory 24, information which is required for drive control of the respective sections at the time of image formation (printing) on the recording sheet S (hereinafter to be called "printing drive control information") is previously stored.

As shown in FIG. 2 as one example, the printing drive control information is stored in the table format for storing respective pieces of information about "paper type", "number of continuous printing sheets", "running time for one sheet", "paper standby time", and "waiting time" for each type of recording sheet S specified as the handling object.

The above-mentioned "number of continuous printing sheets" indicates the number of sheets on which image is to be continuously formed for a particular type of recording sheet S, and the above-mentioned "running time for one sheet" indicates the period of time per recording sheet in which a prescribed location is passed at the time of image formation. In addition, the above-mentioned "paper standby time" indicates the period of time per recording sheet for which, with the main members, such as the photoreceptor drum 50, the developing device 52, the transfer roller 56, the fuser 72, and the like, being continued to be driven, the operation of carrying-out the recording sheet S from the sheet feet cassette 60 or the manual feed tray 68 is halted; and the above-mentioned "waiting time" indicates the period of time for which, after image formation having been continuously performed by the number of sheets as indicated by the above-mentioned "number of continuous printing sheets", the operation of conveying the recording sheet S and the driving of the above-mentioned main members are halted.

In the example as given in FIG. 2, as the printing drive control information for the application where image formation is to be made on plural recording sheets S of A3 size, for example, information which causes image formation to be continuously performed with the running time per recording sheet of 2.0 sec, and the paper standby time of 0.66 sec is stored. In addition, as the printing drive control information for the application where image formation is to be made on plural recording sheets S of non-regular form "a", for example, information which causes image formation to be continuously performed for a set of 20 sheets with the running time per recording sheet of 1.0 sec, and the paper standby time of 2.43 sec, and which provides a waiting time of 60.0 sec between respective continuous image formations is stored.

Thus, with the image forming apparatus 10 pertaining to the present embodiment, image formation on the regular form recording sheet is performed to the last with the running time per sheet and the paper standby time which are predetermined for each type of recording sheet, while, for the non-regular form recording sheet, image formation is continuously performed by the predetermined number of continuous printing sheets with the running time per sheet and the paper standby time which are predetermined for each type of recording sheet, and between respective continuous image formations, the operation of conveying the recording sheet S and the above-mentioned driving of the main members is halted by the predetermined waiting time.

As the above-mentioned number of continuous printing sheets (which corresponds to "the prescribed number of sheets" in the present invention) and the above-mentioned waiting time (which corresponds to "the prescribed periods of time" in the present invention), the values which have been predetermined by the computer simulation based on the specifications for the image forming apparatus 10, the experiments using actual machines, and the like, as those with which image formation can be continuously performed on the corresponding recording sheet S by the number of continuous printing sheets, without the fuser 72 exceeding a prescribed temperature beyond which it would become abnormal are applied.

Figure 3:
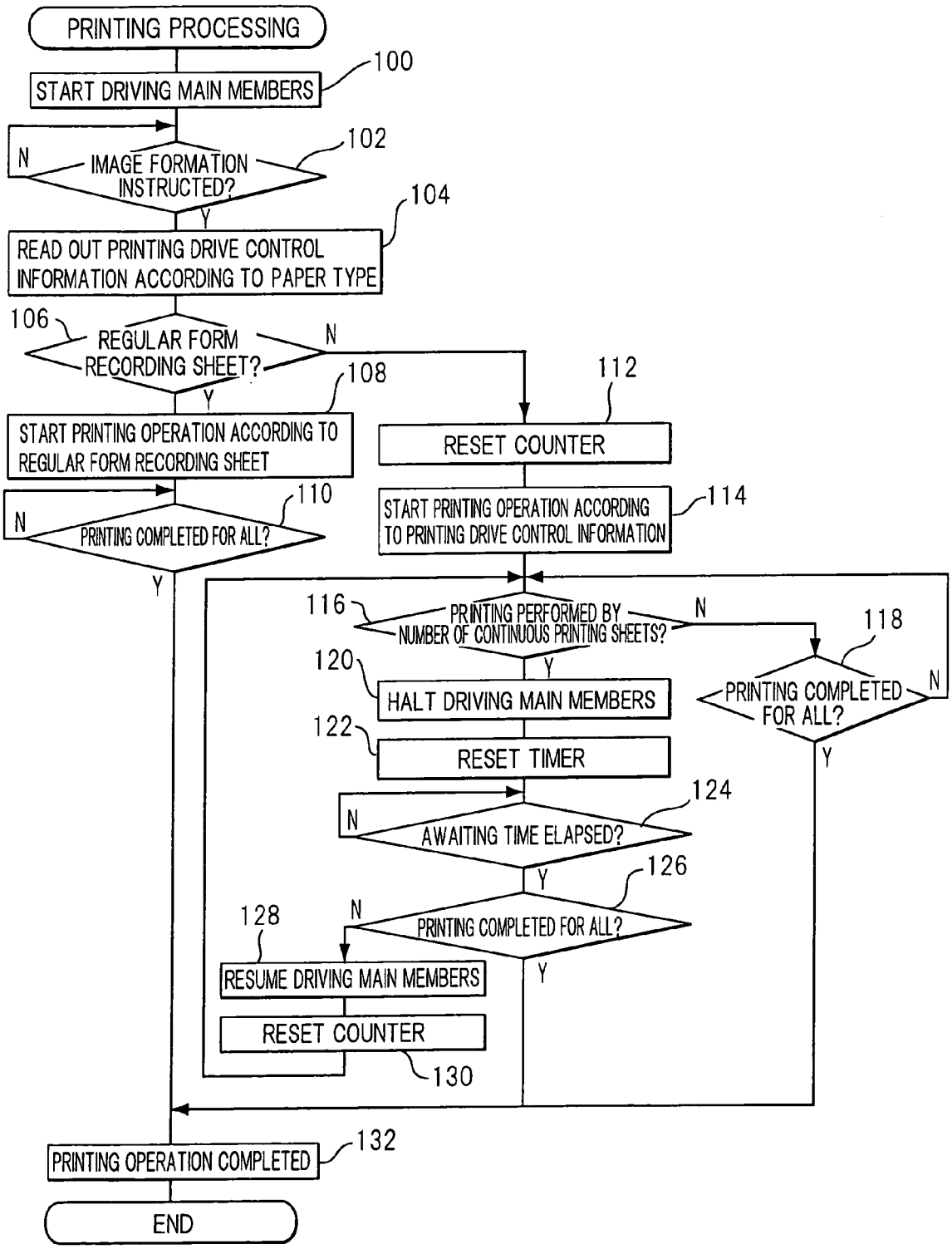
FIG. 3 is a flowchart illustrating a flow of operation of a printing processing program pertaining to the embodiment.

Next, with reference to FIG. 3, the function of the image forming apparatus 10 pertaining to the present embodiment will be described. FIG. 3 is a flowchart illustrating the flow of processing of the printing processing program which is executed by the CPU 22 in the image forming apparatus 10 with the power turned on, the program being previously stored in a prescribed region of the memory 24. In addition, herein, in order to avoid complexity, description of the processings which are not particularly related to the present invention will be omitted whenever possible.

First, at step 100, driving the above-mentioned main members (the photoreceptor drum 50, the developing device 52, the transfer roller 56, the fuser 72, and the like) is started. For example, herein, for the photoreceptor drum 50 and the transfer roller 56, rotation drive is started; for the developing device 52, toner stirring operation, turning operation for the developing roller 54, and the like, are started; and for the fuser 72, turning operation for the heating roller 74 and the pressure roller 76, and heating operation for the heating roller 74, and the like, are started.

At the next step 102, by waiting for input of image information including control information from the external, instruction for image formation is awaited; when image information including control information is inputted from the external (when instruction information is inputted), printing drive control information according to the type of the recording sheet to be used for the image formation that is specified by the control information which has been inputted from the external is read out from the memory 24 at step 104 (also see FIG. 2).

At the next step 106, whether the type of the recording sheet S that has been specified at the above-mentioned step 104 belongs to the regular form recording sheet is determined, and an affirmative determination is given, the processing proceeds to step 108.

At step 108, according to the printing drive control information which has been read out at the above-mentioned step 104, the printing operation prescribed which is common to the regular form recording sheet (the operation in which image formation is continuously performed to the last with the running time per sheet and the paper standby time which are predetermined for each type of recording sheet) is started, and at the next step 110, completion of printing for the number of image forming sheets that is indicated by the above-mentioned control information which has been inputted from the external, which is then followed by the processing proceeding to step 132.

On the other hand, when, at the above-mentioned step 106, a negative determination is given, it is assumed that the type of the recording sheet S that has been specified at the above-mentioned step 104 belongs to the non-regular form recording sheet, the processing proceeding to step 112 to reset the counter 28, and then to step 114.

At step 114, the printing operation according to the printing drive control information which has been read out at the above-mentioned step 104 is started. In the printing operation which is started by the processing at the step 114, image formation on the non-regular form recording sheet of non-regular form "a", for example, involves printing with the running time per recording sheet of 1 sec, and the paper standby time of 2.43 sec. In addition, with this, the value of counting by the counter 28 is incremented by 1 every time the number of image formed sheets is increased by 1.

At the next step 116, the value of counting by the counter 28 is referenced; whether the printing has been performed by the number of sheets that is indicated by the information about number of continuous printing sheets in the printing drive control information that has been read out at the above-mentioned step 104 is determined; when a negative determination is given, the processing proceeds to step 118; whether the printing has been performed by the number of image forming sheets (the total number of printing sheets) that is indicated by the control information inputted from the external is determined; when a negative determination is given, the processing returns to the above-mentioned step 116; and when an affirmative determination is given, the processing proceeds to step 132.

On the other hand, when an affirmative determination is given at the above-mentioned step 116, the processing proceeds to step 120, halting driving the above-mentioned main members; at the next step 122, the timer 26 is reset; thereafter, at step 124, with the value of counting by the timer 26 being referenced, the time as indicated by the waiting time information in the printing drive control information that has been read out at the above-mentioned step 104 (for example, 60.0 sec when the recording sheet S is the non-regular form recording sheet of the non-regular form "a") is awaited to elapse; and then the processing proceeds to step 126.

At step 126, whether the printing has been performed by the number of image forming sheets (the total number of printing sheets) that is indicated by the control information inputted from the external is determined; when a negative determination is given, the processing proceeds to step 128 to resume driving the above-mentioned main members; and at the next step 130, the counter 28 is reset, then the program returns to the above-mentioned step 116. On the other hand, when an affirmative determination is given at the above-mentioned step 126, the processing proceeds to step 132.

At the step 132, the printing operation which has been started at the above-mentioned step 108 or the above-mentioned step 114 is stopped, and thereafter, the present printing processing program is completed.

Figure 4A:
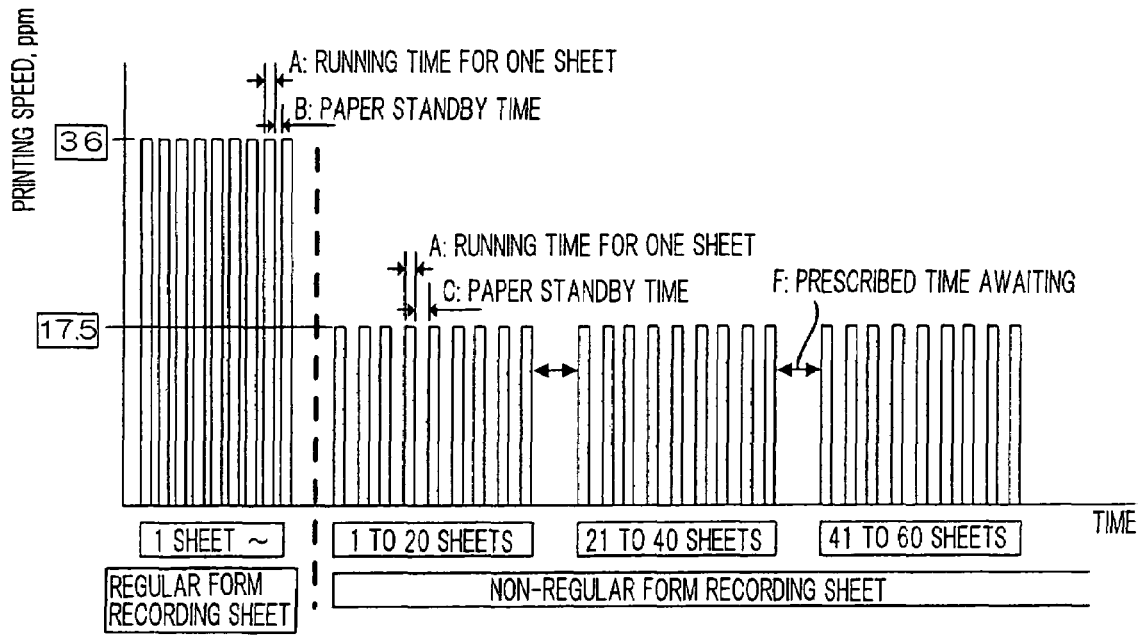
FIG. 4A and FIG. 4B are schemas for use in explanation of an image formation operation of the image forming apparatus 10 pertaining to the embodiment.

By the present printing processing program, as shown in FIG. 4A as one example, for the regular form recording sheet, image formation is performed to the last for each type of the recording sheet S with the running time per sheet "a" and the paper standby time "b" which have been predetermined. Contrarily to this, for the non-regular form recording sheet, image formation is continuously performed by the predetermined number of continuous printing sheets (20 sheets in the same figure) for each type of the recording sheet S with the running time per sheet "a" and the paper standby time "b" which have been predetermined, and between respective continuous image formations, the operation of conveying the recording sheet S, and driving the above-mentioned main members are halted for a predetermined waiting time "f".

Figure 4B:
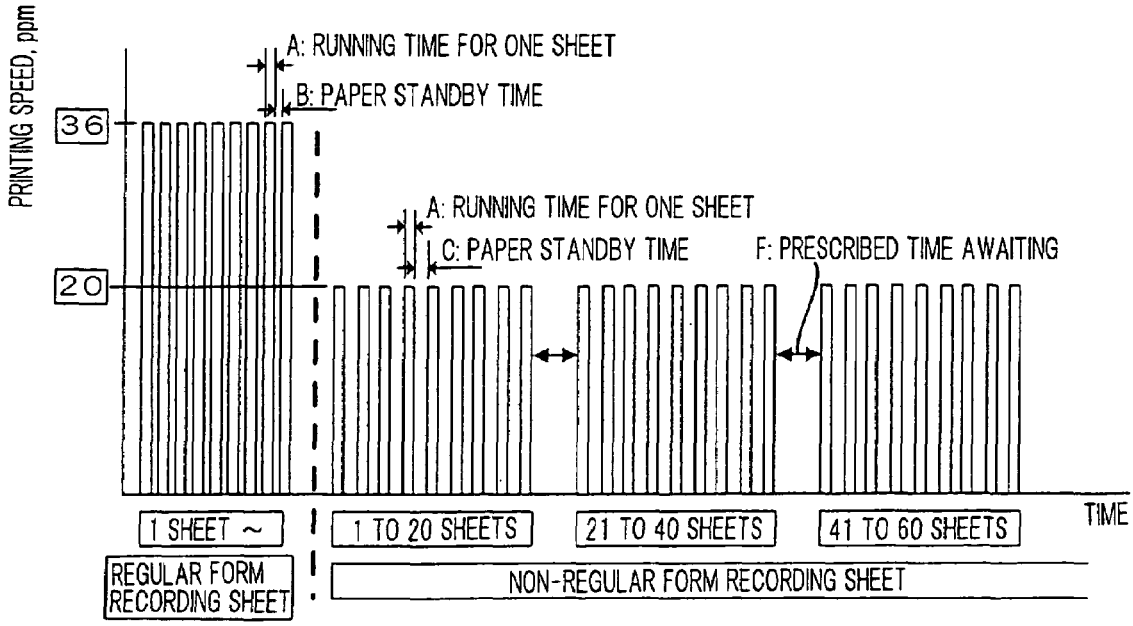
Figure 5:
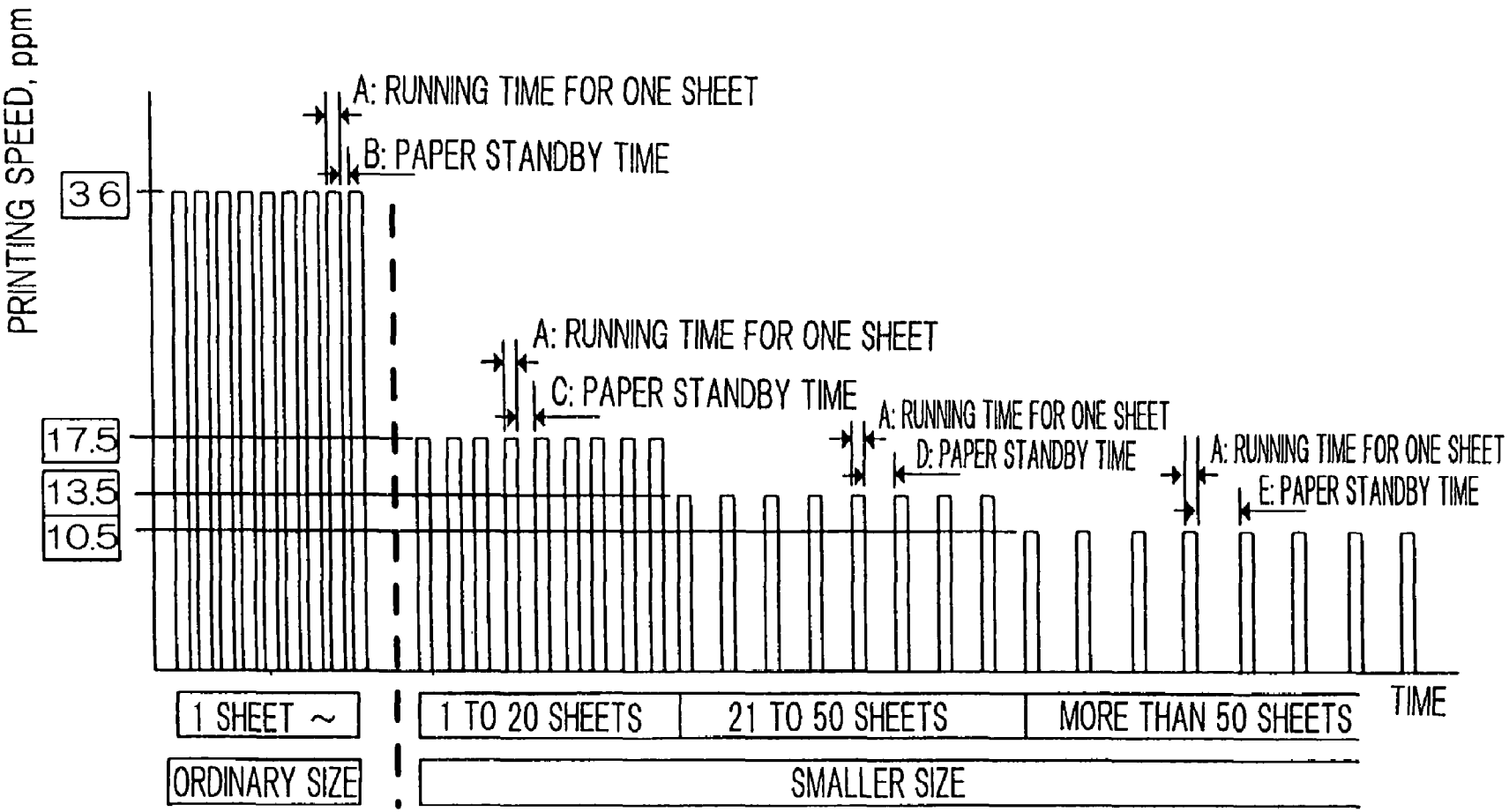
FIG. 5 is a schema for use in explanation of the image formation operation of the conventional image forming apparatus.

The schema as shown in FIG. 4B is the same as that as shown in FIG. 4A, except that the printing speed is different.

As described in detail hereinabove, in the present embodiment, when instruction information (herein, image information and control information) for instructing formation of a developed image on plural recording sheets S is inputted, driving the photoreceptor drum 50, the developing device 52 and the transfer roller 56 is controlled such that formation of a developed image on the plural recording sheets S according to the instruction information is continuously performed, and driving the photoreceptor drum 50, the developing device 52 and the transfer roller 56 is controlled such that, in the course of the continuous image formation, driving the photoreceptor drum 50, the developing device 52 and the transfer roller 56 is halted at least once, thus wear of the photoreceptor drum 50 can be suppressed, and excessive charging of the toner can be suppressed, which allows degradation of the image quality of the recorded image to be suppressed.

In addition, in the present embodiment, driving the photoreceptor drum 50, the developing device 52 and the transfer roller 56 is controlled such that, every time the number of continuously image-formed sheets reaches the prescribed number of sheets for the recording sheet S (herein, the number of continuous printing sheets), driving the photoreceptor drum 50, the developing device 52 and the transfer roller 56 is halted for a prescribed period of time (herein, the waiting time), thus abnormal temperature rise of the photoreceptor drum 50 can be suppressed.

Particularly, in the present embodiment, the prescribed number of sheets and the prescribed periods of time have been determined as those with which image formation on the recording sheet S can be continuously performed by the prescribed number of sheets without the temperature of the fuser 72 exceeding a prescribed one, thus abnormal temperature rise of the fuser 72 can also be reliably prevented.

Further, in the present embodiment, the control is carried out by previously storing the prescribed number of sheets and the prescribed periods of time according to the type of the recording sheet S in the memory 24 for each type of recording sheet S, and reading out the prescribed number of sheets and the prescribed periods of time according to the type of the recording sheet S on which image is to be formed that has been specified from the memory 24, thus plural types of recording sheet can be handled, and only by changing the printing drive control information stored in the memory 24, the printing conditions can easily be altered.

In the present embodiment, a case where driving all of the photoreceptor drum 50, the developing device 52 and the transfer roller 56 is halted between continuous printing periods has been described, however, the present invention is not limited to this, and may be configured such that driving one or two of these members is halted, for example. In this case, when driving of at least one of the photoreceptor drum 50 and the transfer roller 56 is halted, wear of the photoreceptor drum 50 can be suppressed, and when driving the developing device 52 is halted, degradation in image quality of the recorded image can be suppressed.

In addition, the configuration of the image forming apparatus 10 as described in the present embodiment (see FIG. 1 to FIG. 2) is one example, and needless to say it can be appropriately altered within the scope and spirit of the present invention.

Further, the flow of processing of the printing processing program as shown in the present embodiment (see FIG. 3) is also one example, and may be, of course, appropriately altered within the scope and spirit of the present invention.

EXPLANATION OF SIGNS

10 Image forming apparatus
20 Controller
22 CPU (control means, specification means)
24 Memory (memory means)
50 Photoreceptor drum
52 Developing apparatus (developing means)
54 Developing roller
56 Transfer roller (transfer means)
S Recording sheet (image recording medium)

What is claimed is:

1. An image forming apparatus, comprising:

a photoreceptor drum on which, in a driven state, an electrostatic latent image of an image for image formation is optically formed;

developing means which, in a driven state, toner-develops the electrostatic latent image formed on the photoreceptor drum;

transfer means for, in a driven state, transferring to an image recording medium the developed image obtained by toner development by the developing means; and control means which, when instruction information for instructing formation of the developed image on a plurality of sheets of the image recording medium is inputted, controls driving of the photoreceptor drum, the developing means and the transfer means such that formation of the developed image on the plurality of sheets of the image recording medium according to the instruction information is continuously performed, and controls driving of the photoreceptor drum, the developing means and the transfer means such that, in a course of the continuous image formation, driving of the photoreceptor drum, the developing means and the transfer means are halted at least once; and a fuser, which fixes the developed image transferred to the image recording medium on the image recording medium by heat; and wherein the control means controls the photoreceptor drum, the developing means and the transfer means, based on a size of the image recording medium, such that, every time a number of continuously image-formed sheets reaches a prescribed number of sheets of the image recording medium, the photoreceptor drum, the developing means and the transfer means are halted for a prescribed period of time, and the prescribed number of sheets and the prescribed period of time are determined as those with which image formation on the image recording medium can be continuously performed by the prescribed number of sheets without the fuser exceeding a prescribed temperature, wherein the size of the image recording medium is a measure of a printable area of the image recording medium.

2. The image forming apparatus of claim 1, further comprising: specification means for specifying a type of the image recording medium, memory means which stores in advance the prescribed number of sheets and the prescribed period of time according to the type of the image recording medium for each type of the image recording medium, wherein the control means carries out the control by reading out the prescribed number of sheets and the prescribed period of time according to the type of the image recording medium that has been specified by the specification means from the memory means.

3. The image forming apparatus of claim 2, wherein the type of the image recording medium is the type according to at least one of the size of the image recording medium, a thickness of the image recording medium, or a material of the image recording medium.

4. The image forming apparatus of claim 3, further comprising inputting means for inputting information which indicates the type of the image recording medium, wherein the specification means performs the specification on the basis of the type of the image recording medium inputted by the inputting means.

5. The image forming apparatus of claim 2, wherein the specification means further specifies whether the type of the image recording medium is a first type of predetermined regular size, or a second type of non-regular size other than the regular size, and the control means controls driving of at least one of the photoreceptor drum, the developing means or the transfer means such that, in the course of the continuous image formation, driving of at least one of the photoreceptor drum, the developing means or the transfer means is halted at least once.

6. The image forming apparatus of claim 5, further comprising inputting means for inputting information which indicates the type of the image recording medium, wherein the specification means performs the specification on the basis of the type of the image recording medium inputted by the inputting means.

7. The image forming apparatus of claim 2, further comprising inputting means for inputting information which indicates the type of the image recording medium, wherein the specification means performs the specification on the basis of the type of the image recording medium inputted by the inputting means.

8. An image forming apparatus, comprising:

a photoreceptor drum on which, in a driven state, an electrostatic latent image of an image for image formation is optically formed;

developing means which, in a driven state, toner-develops the electrostatic latent image formed on the photoreceptor drum;

transfer means for, in a driven state, transferring to an image recording medium the developed image obtained by toner development by the developing means; and control means which, when instruction information for instructing formation of the developed image on a plurality of sheets of the image recording medium is inputted, controls driving of the photoreceptor drum, the developing means and the transfer means such that formation of the developed image on the plurality of sheets of the image recording medium according to the instruction information is continuously performed, and controls driving of at least one of the photoreceptor drum, the developing means or the transfer means such that, in a course of the continuous image formation, driving of at least one of the photoreceptor drum, the developing means or the transfer means is halted at least once;

specification means for specifying whether a type of the image recording medium is a first type of predetermined regular size, or a second type of non-regular size, other than the regular size, wherein, when the type of the image recording medium is specified to be the second type by the specification means, the control means controls driving of at least one of the photoreceptor drum, the developing means or the transfer means such that, in the course of the continuous image formation, driving of at least one of the photoreceptor drum, the developing means or the transfer means is halted at least once; and regular size and non-regular size are measures of a printable area of the image recording medium.

9. The image forming apparatus of claim 8, further comprising inputting means for inputting information which indicates the type of the image recording medium, wherein the specification means performs the specification on the basis of the type of the image recording medium inputted by the inputting means.

10. An image formation method for an image forming apparatus, comprising a photoreceptor drum on which, in a driven state, an electrostatic latent image of an image for image formation is optically formed; developing means which, in a driven state, toner-develops the electrostatic latent image formed on the photoreceptor drum; and transfer means for, in a driven state, transferring a developed image obtained by toner development by the developing means to an image recording medium, including:

when instruction information for instructing formation of the developed image on a plurality of sheets of the image recording medium is inputted, controlling driving of the photoreceptor drum, the developing means and the transfer means such that formation of a developed image on a plurality of sheets of the image recording medium according to the instruction information is continuously performed, and controlling driving of at least one of the photoreceptor drum, the developing means or the transfer means such that, in a course of the continuous image formation, driving of at least one of the photoreceptor drum, the developing means or the transfer means is halted at least once;

specifying whether a type of the image recording medium is a first type of predetermined regular size, or a second type of non-regular size other than the regular size, and when the type of the image recording medium is specified to be the second type by the specification means, controlling driving of at least one of the photoreceptor drum, the developing means or the transfer means such that, in the course of the continuous image formation, driving of at least one of the photoreceptor drum, the developing means or the transfer means is halted at least once, wherein regular size and non-regular size are measures of a printable area of the image recording medium.

11. The image formation method of claim 10, further including:

controlling at least one of the photoreceptor drum, the developing means or the transfer means such that, every time a number of continuously image-formed sheets reaches a prescribed number of sheets of the image recording medium, at least one of the photoreceptor drum, the developing means or the transfer means is halted for a prescribed period of time.

* * * * *